US005479984A

United States Patent [19]

Easterbrook et al.

[11] Patent Number: 5,479,984

[45] Date of Patent: Jan. 2, 1996

[54] REMOVABLE POSITIVE SHUT-OFF PANEL

[75] Inventors: David Easterbrook; Michael Butorac, both of Toronto, Canada

[73] Assignee: Eastorac Corporation, Toronto, Canada

[21] Appl. No.: 255,714

[22] Filed: Jun. 7, 1994

[51] Int. Cl.[6] ..... F24F 13/08

[52] U.S. Cl. ..... 165/96; 49/465; 251/901; 454/284; 454/289

[58] Field of Search ..... 165/96, 98; 454/284, 454/289; 49/463, 465, 478.1; 251/901

[56] References Cited

U.S. PATENT DOCUMENTS

| | | | |
|---|---|---|---|
| 3,831,321 | 8/1974 | Johnson | 49/465 |
| 3,894,527 | 7/1975 | Ickes | 49/466 X |
| 3,951,168 | 4/1976 | Roberts | 251/901 X |
| 4,389,827 | 6/1983 | Van Valkenburg | 49/465 X |
| 4,502,368 | 3/1985 | Hempel | 454/277 |
| 4,520,715 | 6/1985 | Coomes et al. | 454/367 |
| 4,686,893 | 8/1987 | Jinkins | 454/284 |
| 5,213,543 | 5/1993 | Clarino | 454/292 |
| 5,230,657 | 7/1993 | Opoka | 454/289 |

*Primary Examiner*—Leonard R. Leo
*Attorney, Agent, or Firm*—James Creighton Wray

[57] ABSTRACT

A register of a forced air system is sealed by placing a heavy flexible magnetic panel over the register and adhering the entire panel to the entire register for preventing escape of forced air from the register. The flexible magnetic panel is used on wall registers, on floor registers and on ceiling registers.

7 Claims, 1 Drawing Sheet

FIG. 1
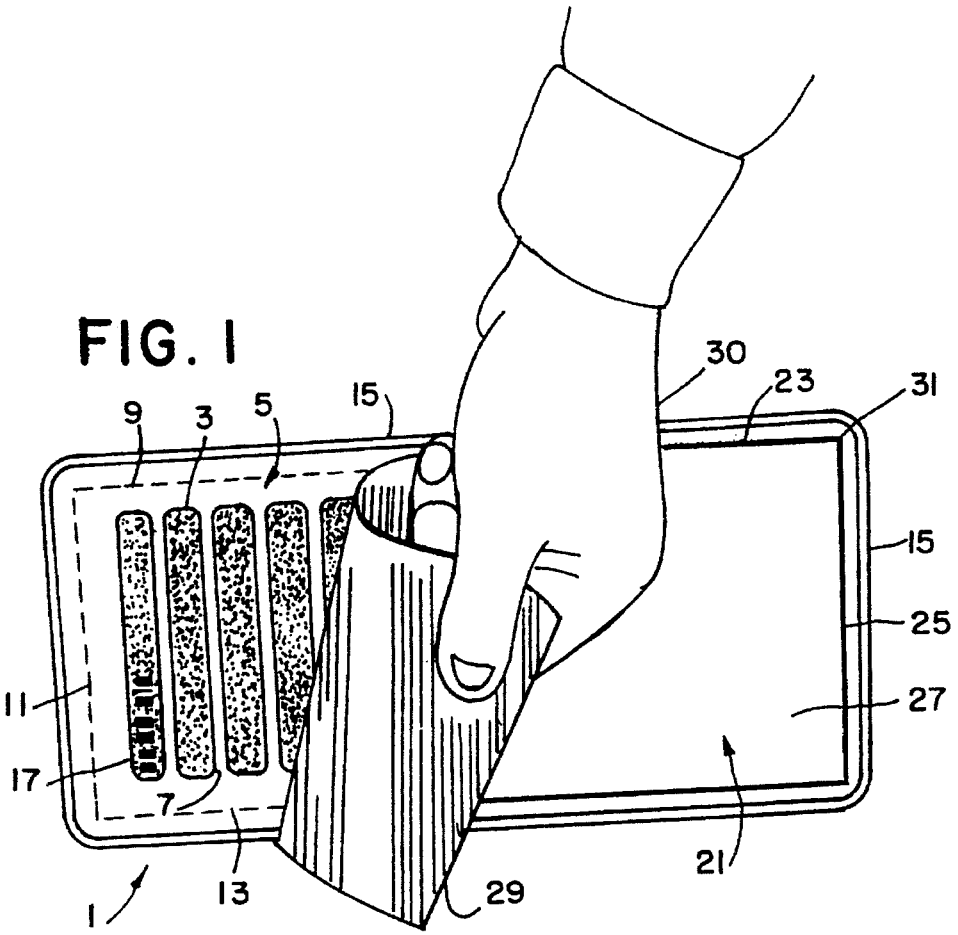
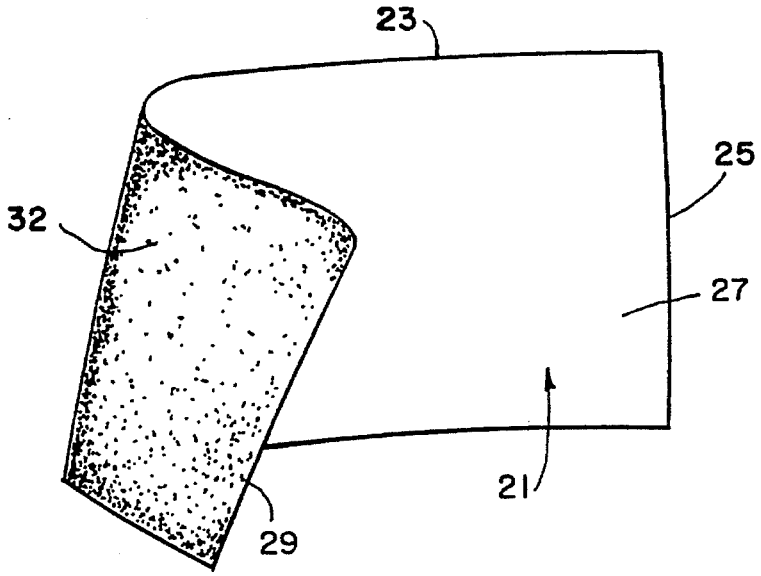
FIG. 2

REMOVABLE POSITIVE SHUT-OFF PANEL

BACKGROUND OF THE INVENTION

This invention relates to registers for forced air systems.

Forced air heating and cooling systems provide an economical and quick reaction to desired temperature changes in a structure. Forced air systems are used in winter for heating by blowing air around a fire box, which may be fueled by gas, oil or coal, or around an electrical or fluid heat source, and then blowing the air through a register and through sealed ducts along floors and wall, and then finally releasing the air through registers, which are wall, floor or ceiling mounted. The air is drawn into the system through large intakes, is collected through intake ducts, and is again blown around the heat source or sealed fire box to heat the air. In summer, often the same forced air system is used. A heat exchanger is imposed across the major duct, and a refrigeration system outside of the structure draws fluid from the heat exchanger, compresses the fluid, cools the compressed fluid and returns the fluid to the heat exchanger for expansion and cooling the heat exchanger. The forced air is circulated over, around and through the heat exchanger, is cooled, and is circulated through the ducts and branch ducts, out of the registers and through the structure before it is returned to the heat exchanger.

Heat pumps use forced air systems. An outside refrigeration unit flows either hot fluid or compressed and cooled fluid to a heat exchanger in a main interior unit. A blower drives air through room return intakes and through intake ducts, and blows the air through the heat exchanger and the ducting system and branch ducts, and releases the air through the wall, ceiling and floor mounted registers or any of those registers.

When designing structures and forced air systems for the structures, much attention is given to the size and straightness of the main duct and to the size of the branch ducts, and to positioning of registers within rooms. The positioning of registers in rooms is made more difficult by dual-purpose heating and air conditioning systems. Registers for heating are best positioned near a floor, and registers for cooling are best positioned near a ceiling. Heated air tends to flow upward and cool air tends to flow downward.

Standard registers are about 3 inches by 10 inches, or 4 inches by 10 inches, according to the size of the room and available space for installation.

Modifications are often made in air handling ducts to provide the best circulation of air with the most appropriate placement of the furnace, heat exchanger or blower. While a central location in a basement might be most desirable, for example, that location may be avoided for purposes of maintaining available open space.

The ducting system may or may not be modified to accommodate for the offset heating, cooling and blowing equipment. Very large structures often have more than one separate heating and air conditioning system so that temperatures in zones may be regulated. Design constraints may change heating and cooling of differentiated areas within the zones.

During the use of structures, heating and cooling characteristics differing from the designed and actual characteristics of the system might be desired. Changing the system is often difficult or impossible.

In some structures, it may be desirable to conserve energy by limiting the heating or cooling of the forced air system to those areas which are actually in use.

It may be desirable to keep areas such as bedrooms cooler than bathrooms, kitchen, family room and living room areas.

Registers are often provided with louvers for adjusting and directing the air flows. The louvers may also be used for closing or partially closing the register. While the louvers may be effective in partially closing the register, they are primarily intended for directing air at angles from the register, and usually they do not completely seal the register.

If it becomes necessary to seal a register a person often resorts to cardboard taped to the register, which is unsightly and leaves an unsightly residue which attracts and holds dirt on the face of the register. Other alternatives are removing the register, placing a cardboard cutout inside the register, and replacing the register on the wall. That is a time consuming solution which requires the use of tools. Neither of those solutions facilitates periodic daily sealing and opening which may be desirable.

Particularly in the heating season, a high relative humidity is desirable in the interior of structures. Use of forced air heating tends to reduce humidity. Special systems restore humidity, but careful monitoring of those systems is required to make sure that those systems do not introduce health hazards into the air. A better solution is to reduce the on-time of the heater while keeping the temperature of living spaces in a comfort range. That may be best accomplished by sealing registers in non-used spaces during periods of non-use.

SUMMARY OF THE INVENTION

The present invention solves problems existing in the prior art and provides a complete temporary or permanent shut-off for registers. The system is intended to completely seal the registers. However, the system may be partially displaced to precisely vary and control the flow of air from the register. When not in use, the system may be attached to any convenient metal surface ready for re-use.

The field or art to which the invention applies is heating and air conditioning duct work or registers. The prior art used built-in dampers, pieces of cardboard or other sheet material adhered with tape, glue or screws or packing material to block ducts.

The invention provides for air registers a flexible vinyl cover of desired dimensions having adherent magnetized material. The invention is used as an effective means to save energy. By applying the flexible magnetic vinyl cover on heating registers or air conditioning registers, the air flow is effectively, quickly and completely shut off. The air flow may be restored just as quickly.

The invention provides a flexible panel of appropriate dimensions which adheres magnetically to the room side of standard heating registers in forced-air heating and air conditioning systems, providing a means of positive shut-off of air flow.

In summer the panels are placed over registers in a basement to avoid a too cold basement. In winter the panels are placed over registers in unused rooms or areas to save on heating. No complex installation is necessary. The panels attach magnetically to registers.

The present invention provides a simple, yet effective way to balance heating or cooling in a home. For a central forced air system, the invention provides a means of balancing air flow. In summer, if the basement is too cool, panels are placed over the basement registers. In winter, if it is overly warm in any area, or if some rooms are not in use, panels are placed on registers in those areas or rooms.

With the present invention, one can easily shut off air flow, or re-establish it, in seconds, without the use of tape or tools. Heating or cooling can be redirected to others parts of a home, making them more comfortable. The thermostat will reach its target temperature faster, so energy is saved.

The present panels adhere to registers by magnetism. They stay in place, even in wall or ceiling situations. The panels are available in packages of three to fit 3 inch by 10 inch and 4 inch by 10 inch registers.

The present magnetic panels provide positive shut-off of registers.

A register of a forced air system is sealed by placing a heavy flexible magnetic panel over the register and adhering the entire panel to the entire register for preventing escape of forced air from the register. The flexible magnetic panel is used on wall registers, on floor registers and on ceiling registers.

A preferred heating and cooling register sealing apparatus has a flexible plastic panel made of magnetic material, which has a rectangular shape for adhering the entire panel to the entire surface of a register to prevent air from escaping from the register.

A preferred method of sealing a register in a forced air system comprises placing a flexible heavy plastic panel over the register and adhering the entire panel to the register by magnetic attraction from magnets in the flexible panel.

These and further and other objects and features of the invention are apparent in the disclosure, which includes the above and ongoing written specification, with the claims and the drawings.

BRIEF DESCRIPTION OF THE DRAWINGS

FIG. 1 shows the application or removal of a self-adhering sealing panel of the present invention from a register.

FIG. 2 shows another prefered panel of the present invention.

DETAILED DESCRIPTION OF THE DRAWINGS

Referring to FIG. 1, a wall-mounted register is generally indicated by the numeral 1. The register 1, which may be a ceiling-mounted register or a floor-mounted register, is made of a sheet metal blank which is lanced centrally to provide openings 3 in a grill 5. Edges of the grill bars 7 may be turned under or around radiuses to avoid sharp corners. The grill is formed with a frame 9 which has a short portion 11, usually about 3 or 4 inches long, and a long portion 13, usually about 10 inches long. Edges 15 are rolled rearward to provide an appearance and safety feature. A sliding or turning control 17 is provided to change orientation of coupled louvers in the back of the register 1 to direct air flow out of the openings 3.

The present invention provides a sealing plate 21 for the registers. The flexible sealing plate 21 has long edges 23 about 10 inches long, and short edges 25 which are from 3 to 4 inches long. The outer face 27 is formed with a plain base color, usually white, antique white or off-white, to provide a pleasant appearance which is coordinated with the edges 15 of the register. The vinyl surface 27 is ready to accept interior paint, such as interior latex, to match the wall cover. Alternatively, if the wall is papered, a small piece made from installation scrap of the paper may be pasted to the outer surface 27, or edges of the paper may be folded around the edges 23 and 25 of the panel 21.

The panel is a heavy-duty flexible panel which contains magnetized magnetic material, which adheres tightly to the frame 9 and the grill 5 of the register. The panel is placed on a register by grasping one edge 29 of the panel with a hand 30, and aligning the other edge 25 on one edge of the register. Then the panel 2 is rolled into place, carefully aligning the edges 23 with the elongated frame members 13 as the rolling of the panel is completed. Finally, the edge 29 is adhered to the frame portion 11, and the register 1 is completely covered. To remove the panel, a corner 31 is grasped, and the panel is flexed and peeled away from the register.

In another preferred embodiment, as shown in FIG. 2, the panel is a rubber-like sheet with magnetic material 32 embedded therein.

When the panel is intended to be replaced shortly, the panel may be stored by contacting the panel with any convenient metal surface, including duct work, furnace, etc.

When it is desired to permit a reduced flow of air from the register, the panel may be placed in an offset position with respect to the register, leaving a long opening of the grill 5 along the top or bottom of the panel, or along one side edge 25 of the panel, or leaving an L-shaped opening along one long edge and one short edge.

while the invention has been described with reference to specific embodiments, modifications and variations of the invention may be constructed without departing from the scope of the invention, which is defined in the following claims.

We claim:

1. A heating and cooling register apparatus, comprising a flexible plastic panel made of magnetic material and having a rectangular shape for adhering the panel to the surface of a register and to prevent air from escaping from the register.

2. The apparatus of claim 1, wherein the panel is a rubber-like sheet with embedded magnetic material.

3. The apparatus of claim 2, wherein the sheet is about 3/16th inch thick, about 3 to 4 inches wide and about 10 inches long.

4. The method of sealing a register in a forced air system, comprising placing a flexible plastic panel over the register and adhering the panel to the register by magnetic attraction from magnets in the flexible panel.

5. The method of claim 4, further comprising attaching the panel by rolling the panel and aligning and attaching one edge of the panel to a corresponding frame edge of a register, and then unrolling and flattening the panel against remaining frame edges and a central grating of the register.

6. The method of claim 5, further comprising removing the panel by lifting one corner of the panel and rolling the panel away from the frame edges and central grating of the register.

7. The method of claim 6, further comprising storing the panel by attaching the panel to any convenient metal surface ready for re-use.

* * * * *